US009403282B2

(12) United States Patent
Sueda

(10) Patent No.: US 9,403,282 B2
(45) Date of Patent: Aug. 2, 2016

(54) DIAMOND-CONTAINING BLADE

(75) Inventor: Kimiko Sueda, Tokyo (JP)

(73) Assignee: FOREVER CO., LTD., Saitama-Ken (JP)

( * ) Notice: Subject to any disclaimer, the term of this patent is extended or adjusted under 35 U.S.C. 154(b) by 594 days.

(21) Appl. No.: 13/609,067

(22) Filed: Sep. 10, 2012

(65) Prior Publication Data

US 2013/0133209 A1 May 30, 2013

(30) Foreign Application Priority Data

Nov. 29, 2011 (JP) ..... 2011-007011

(51) Int. Cl.
*B26B 21/60* (2006.01)

(52) U.S. Cl.
CPC ..... *B26B 21/60* (2013.01)

(58) Field of Classification Search
CPC ..... B23P 15/28; B26B 9/00; B22F 3/12; B22F 7/02
USPC ..... 30/346.54, 350; 76/115–119; 51/309
See application file for complete search history.

(56) References Cited

U.S. PATENT DOCUMENTS

| | | | | | |
|---|---|---|---|---|---|
| 3,356,473 | A * | 12/1967 | Hull et al. | 51/309 |
| 4,246,006 | A * | 1/1981 | Phaal | 51/309 |
| 4,394,170 | A * | 7/1983 | Sawaoka et al. | 51/309 |
| 4,453,987 | A * | 6/1984 | Arai et al. | 30/346.53 |
| 4,755,237 | A * | 7/1988 | Lemelson | 219/121.69 |
| 4,923,490 | A * | 5/1990 | Johnson et al. | 51/309 |
| 5,069,872 | A * | 12/1991 | Penoza | 30/350 |
| 5,232,469 | A * | 8/1993 | McEachron et al. | 51/309 |
| 5,864,955 | A * | 2/1999 | Hirai | 30/350 |
| 5,983,507 | A * | 11/1999 | Hirai | 30/350 |
| 6,105,261 | A * | 8/2000 | Ecer | 30/346.54 |
| 6,447,569 | B1 | 9/2002 | Sueta | |
| 7,043,819 | B1 * | 5/2006 | Arnold | 30/350 |
| 8,592,711 | B2 * | 11/2013 | Lambert | 30/350 |
| 8,776,382 | B2 * | 7/2014 | Ochiai et al. | 30/350 |
| 2003/0176252 | A1 * | 9/2003 | Tsujii et al. | 474/213 |
| 2005/0025655 | A1 * | 2/2005 | Ryota | 419/38 |
| 2005/0142020 | A1 * | 6/2005 | Akira | 419/17 |
| 2006/0185254 | A1 * | 8/2006 | Hirai et al. | 51/309 |
| 2007/0163128 | A1 * | 7/2007 | Tarrerias | 30/350 |
| 2009/0241352 | A1 * | 10/2009 | Sueda et al. | 30/350 |
| 2010/0000389 | A1 * | 1/2010 | Chang et al. | 30/347 |

(Continued)

FOREIGN PATENT DOCUMENTS

| | | |
|---|---|---|
| EP | 1 070 764 A1 | 1/2001 |
| EP | 2 105 266 A2 | 9/2009 |

(Continued)

*Primary Examiner* — Jason Daniel Prone
(74) *Attorney, Agent, or Firm* — Wells St. John P.S.

(57) ABSTRACT

A diamond-containing blade includes a blade body having at proximal end a connection part to be fitted into a gripper; and an edge longitudinally formed along one side of the blade body, wherein the blade is manufactured by a process in which a powder mixture for constituting the edge, including 20 wt % or less of diamond particles coated with Ti and having a particle size of 20 μm or less and residual Ti powder or Ti alloy powder, is charged in a space of a mold corresponding to the edge, Ti powder or Ti alloy powder for constituting the blade body is charged in another space of the mold corresponding to the blade body, the charged powders are pressed to obtain a molded product, the molded product is sintered to obtain a sintered body, and then an edge of the sintered body is sharpened.

2 Claims, 2 Drawing Sheets

(56) References Cited

U.S. PATENT DOCUMENTS

| | | | | |
|---|---|---|---|---|
| 2012/0270005 | A1* | 10/2012 | Baratta | 428/77 |
| 2012/0317822 | A1* | 12/2012 | Ochiai et al. | 30/350 |

FOREIGN PATENT DOCUMENTS

| | | | | |
|---|---|---|---|---|
| EP | 12183969 | | | 3/2013 |
| JP | 2-029707 | | | 2/1990 |
| JP | 05068754 | A | * | 3/1993 |
| JP | 2001-025585 | | | 1/2001 |
| JP | 2004-009146 | | | 1/2004 |
| WO | WO 02/100610 | A1 | | 12/2002 |
| WO | WO 2005/005110 | A1 | | 1/2005 |

* cited by examiner

DIAMOND-CONTAINING BLADE

CROSS REFERENCE TO RELATED APPLICATION

This application claims the benefit of Japanese Utility Model Application No. JP 2011-007011, filed on Nov. 29, 2011, which is hereby incorporated by reference in its entirety into this application.

BACKGROUND OF THE INVENTION

1. Technical Field

The present invention relates to a diamond-containing blade, and, more particularly, to a diamond-containing blade of a hand-operated tool such as a knife, cutter, scissors or the like, which includes diamond particles as an ultrahard material.

2. Description of the Related Art

Conventionally, although diamond particle-containing blades have already been developed, they have been mostly used in industrial electrically-powered cutters or cup wheels for cutting tools. Further, there was a few of diamond particle-containing blades of hand-operated tools such as knives, cutters, scissors and the like.

As examples of diamond particle-containing blades, Japanese Unexamined Patent Application Publication No. 2001-25585 discloses a diamond-containing blade material which is formed by attaching an edge to a sintered compact formed using diamond particles having a particle size of 100 μm or less as a cutting material and then sintering the cutting material together with pure titanium particles or titanium alloy particles as a matrix (medium) of the diamond particles (refer to Patent document 1); Japanese Unexamined Patent Application Publication No. 2004-9146 discloses a disc-shaped round blade for cutting a belt-like material by shearing, wherein a side part is formed in the radial direction, an outer peripheral surface part is formed in the cross direction, and an intersecting part of the side part and the outer peripheral surface part serves as the edge of the blade, and wherein at least the side part of the blade edge is plated with diamond particles or borazon particles with a binder medium formed and extending in the circumferential direction by electrodeposition (refer to Patent document 2); and Japanese Unexamined Utility Model Application Publication No. H02-29707 discloses a cement plate cutter which pivots blades facing each other at one end thereof and which is operated by a toggle provided at the other end thereof, wherein the blades facing each other are uniformly electrodeposited with diamond particles having a particle size of 0.07~0.08 mm (refer to Patent document 3).

CITED REFERENCES

Patent Documents (Patent document 1) Japanese Unexamined Patent Application Publication No. 2001-25585

(Patent document 2) Japanese Unexamined Patent Application Publication No. 2004-9146

(Patent document 3) Japanese Unexamined Utility Model Application Publication No. H02-29707

SUMMARY OF THE INVENTION

However, the above-mentioned diamond-containing blade material disclosed in Patent document 1 is problematic in that, although a hand-operated tool, such as a kitchen knife or the like, is provided with a blade made of a sintered body obtained by sintering diamond particles having a particle size of 100 μm or less together with pure titanium particles, the edge of the blade becomes rough, and the sintered diamond particles and pure titanium particles are different kinds of materials, so that the adhesion therebetween is not good. Further, the disc-shaped round blade disclosed in Patent document 2 is problematic in that, although it is electrodeposited with diamond particles, it is used only to cut a belt-like material. Furthermore, the cement plate cutter disclosed in Patent document 3 is problematic in that, although its blade is electrodeposited with diamond particles having a particle size of 0.07~0.08 mm, the edge of the blade becomes rough and adhesivity is not good.

The present invention has been devised to solve the above problems. An object of the present invention is to provide a diamond-containing blade, including: a blade body having at proximal end a connection part to be fitted into a gripper; and an edge longitudinally formed along one side of the blade body, wherein the blade is manufactured by a process in which a powder mixture for constituting the edge, including 20 wt % or less of diamond particles coated with Ti and having a particle size of 20 μm or less and residual Ti powder or Ti alloy powder, is charged in a space of a mold corresponding to the edge, Ti powder or Ti alloy powder for constituting the blade body is charged in another space of the mold corresponding to the blade body, the charged powders are pressed to obtain a molded product, the molded product is sintered to obtain a sintered body, and then an edge of the sintered body is sharpened. Here, the powder mixture for constituting the edge may include 20 wt % or less of diamond particles coated with Ti and having a particle size of 20 μm or less, 30 wt % or less of vanadium carbide (VC) particles having a particle size of 10 μm or less and residual Ti powder or Ti alloy powder. Further, the powder mixture for constituting the edge may include 20 wt % or less of diamond particles coated with Ti and having a particle size of 20 μm or less, 30 wt % or less of titanium carbide (TiC) particles having a particle size of 10 μm or less and residual Ti powder or Ti alloy powder.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
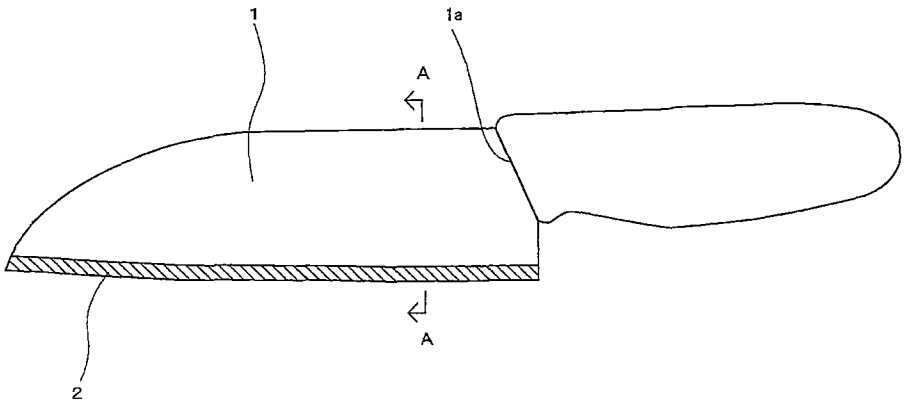
FIG. 1 is a front view showing a diamond-containing blade according to an embodiment of the present invention.
Figure 2:
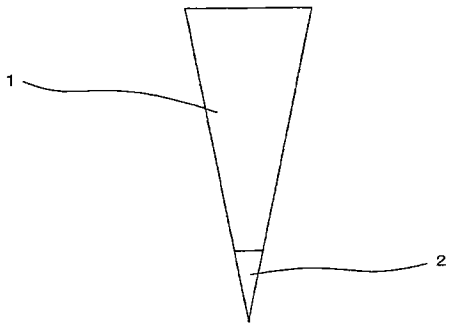
FIG. 2 is a cross-sectional view showing the diamond-containing blade taken along the line A-A of FIG. 1.

Hereinafter, preferred embodiments of the present invention will be described in detail with reference to the accompanying drawings. FIG. 1 is a front view showing a diamond-containing blade according to an embodiment of the present invention, and FIG. 2 is a cross-sectional view showing the diamond-containing blade taken along the line A-A of FIG. 1.

The present invention relates to a diamond-containing blade, and, more particularly, to a diamond-containing blade of a hand-operated tool such as a knife, cutters, scissors or the like, which includes diamond particles as an ultrahard material. The diamond-containing blade according to a first embodiment of the present invention includes: a blade body 1 having at proximal end a connection part 1*a* to be fitted into a gripper; and an edge 2 longitudinally formed along one side of the blade body, wherein the blade is manufactured by a process in which a powder mixture for constituting the edge, including 20 wt % or less of diamond particles coated with Ti and having a particle size of 20 μm or less and residual Ti powder or Ti alloy powder, is charged in a space of a mold corresponding to the edge, Ti powder or Ti alloy powder for constituting the blade body is charged in another space of the mold corresponding to the blade body, the charged powders are pressed to obtain a molded product, the molded product is sintered to obtain a sintered body, and then an edge of the sintered body is sharpened.

The diamond-containing blade according to a second embodiment of the present invention includes: a blade body 1 having at proximal end a connection part 1*a* to be fitted into a gripper; and an edge 2 longitudinally formed along one side of the blade body, wherein the blade is manufactured by a process in which a powder mixture for constituting the edge, including 20 wt % or less of diamond particles coated with Ti and having a particle size of 20 μm or less, 30 wt % or less of vanadium carbide (VC) particles having a particle size of 10 μm or less and residual Ti powder or Ti alloy powder, is charged in a space of a mold corresponding to the edge, Ti powder or Ti alloy powder for constituting the blade body is charged in another space of the mold corresponding to the blade body, the charged powders are pressed to obtain a molded product, the molded product is sintered to obtain a sintered body, and then an edge of the sintered body is sharpened.

The diamond-containing blade according to a third embodiment of the present invention includes: a blade body 1 having at proximal end a connection part 1 a to be fitted into a gripper; and an edge 2 longitudinally formed along one side of the blade body, wherein the blade is manufactured by a process in which a powder mixture for constituting the edge, including 20 wt % or less of diamond particles coated with Ti and having a particle size of 20 μm or less, 30 wt % or less of titanium carbide (TiC) particles having a particle size of 10 μm or less and residual Ti powder or Ti alloy powder, is charged in a space of a mold corresponding to the edge, Ti powder or Ti alloy powder for constituting the blade body is charged in another space of the mold corresponding to the blade body, the charged powders are pressed to obtain a molded product, the molded product is sintered to obtain a sintered body, and then an edge of the sintered body is sharpened.

[Embodiments]

That is, the diamond-containing blade of the present invention is the blade of a hand-operated tool such as a knife, cutter, scissors or the like. The diamond-containing blade includes a blade body 1 having at proximal end a connection part la to be fitted into a gripper; and an edge 2 longitudinally formed along one side of the blade body.

The diamond particles are coated with titanium (Ti) and have a particle size of 20 μm or less. When the particle size thereof is 20 μm or less, the blade can have the appropriate sharpness, but, when the particle size thereof is more than 20 μm, the blade becomes rough, thus deteriorating the sharpness of the blade.

The powder mixture for constituting the edge includes 20 wt % or less of diamond particles coated with titanium (Ti) suitable for improving the rust resistance of the diamond particles and having a particle size of 20 μm or less, and residual Ti powder or Ti alloy powder. The powder mixture is used to form the edge 2 of the blade.

The powder for constituting the blade body includes Ti powder or Ti alloy powder, and is used to form the blade body 1.

The molded product is formed using a mold. Specifically, the molded product is obtained by charging the powder for constituting the blade body in a space of the mold corresponding to the blade body and charging the powder mixture for constituting the edge in another space of the mold and then integrally pressing the charged powders.

The sintered body is obtained by sintering the molded body, which has been obtained by pressing the charged powders, at a predetermined high temperature. The two different kinds of the charged powders are integrally molded.

The edge of the blade is sharpened by grinding the edge 2 of the sintered body. As shown in FIG. 2, since diamond particles are present in the edge of the blade throughout the thickness thereof, the deterioration in sharpness of the edge of the blade attributable to the aging thereof can be overcome by continuously carrying out grinding.

In the diamond-containing blade according to another embodiment of the present invention, the powder mixture for constituting the edge may further include vanadium carbide (VC) particles. That is, the powder mixture for constituting the edge may include 20 wt % or less of diamond particles coated with Ti and having a particle size of 20 μm or less, 30 wt % or less of vanadium carbide (VC) particles having a particle size of 10 μm or less and residual Ti powder or Ti alloy powder, based on 100 wt % of the total amount thereof. The edge of the blade may be rendered ultrahard by the addition of vanadium carbide (VC) particles.

In the diamond-containing blade according to still another embodiment of the present invention, the powder mixture for constituting the edge may further include titanium carbide (TiC) particles. That is, the powder mixture for constituting the edge may include 20 wt % or less of diamond particles coated with Ti and having a particle size of 20 μm or less, 30 wt % or less of titanium carbide (TiC) particles having a particle size of 10 μm or less and residual Ti powder or Ti alloy powder, based on 100 wt % of the total amount thereof. The edge of the blade may be rendered ultrahard by the addition of vanadium titanium carbide (TiC) particles.

As described above, the diamond-containing blade of the present invention is configured such that the blade is manufactured by a process in which a powder mixture for constituting the edge, including 20 wt % or less of diamond particles coated with Ti and having a particle size of 20 μm or less and residual Ti powder or Ti alloy powder, is charged in a space of a mold corresponding to the edge, Ti powder or Ti alloy powder for constituting the blade body is charged in another space of the mold corresponding to the blade body, the charged powders are pressed to obtain a molded product, the molded product is sintered to obtain a sintered body, and then an edge of the sintered body is sharpened. Therefore, the diamond-containing blade of the present invention is effective as follows. Since expensive diamond particles are included only in the edge of the blade, the production cost of the blade can be reduced. Further, the deterioration in cutting ability of the blade, which is caused by the wear of the edge of the blade attributable to the passage of time, can be compensated for by grinding the blade. Further, since diamond particles are coated with Ti and then mixed with Ti powder or Ti alloy powder, the adhesion between diamond particles and Ti powder or Ti alloy powder is good. Furthermore, since the edge of the blade additionally include vanadium carbide (VC) particles or titanium carbide (TiC) particles, the edge of the blade is ultrahard.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A diamond-containing blade, comprising:

a blade body having at proximal end a connection part to be fitted into a gripper; and an edge longitudinally formed along one side of the blade body, wherein the blade is manufactured by a process in which a powder mixture for constituting the edge, including more than 0 wt % and 20 wt % or less of diamond particles coated with Ti and having a particle size of more than 0 μm and 20 μm or less, more than 0 wt % and 30 wt % or less of vanadium carbide (VC) particles having a particle size of more than 0 μm and 10 μm or less and residual Ti powder or Ti alloy powder, is charged in a space of a mold corresponding to the edge, Ti powder or Ti alloy powder for constituting the blade body is charged in another space of the mold corresponding to the blade body, the charged powders are pressed to obtain a molded product, the molded product is sintered to obtain a sintered body, and then the edge of the sintered body is sharpened.

2. A diamond-containing blade, comprising:

a blade body having at proximal end a connection part to be fitted into a gripper; and an edge longitudinally formed along one side of the blade body, wherein the blade is manufactured by a process in which a powder mixture for constituting the edge, including more than 0 wt % and 20 wt % or less of diamond particles coated with Ti and having a particle size of more than 0 μm and 20 μm or less, more than 0 wt % and 30 wt% or less of titanium carbide (TiC) particles having a particle size of more than 0 μm and 10 μm or less and residual Ti powder or Ti alloy powder, is charged in a space of a mold corresponding to the edge, Ti powder or Ti alloy powder for constituting the blade body is charged in another space of the mold corresponding to the blade body, the charged powders are pressed to obtain a molded product, the molded product is sintered to obtain a sintered body, and then the edge of the sintered body is sharpened.

* * * * *